US006045011A

United States Patent [19]

Yang

[11] Patent Number: 6,045,011

[45] Date of Patent: Apr. 4, 2000

[54] SEASONING SPRAYER

[76] Inventor: Heng-Te Yang, P.O. Box 90, Tainan City, Taiwan

[21] Appl. No.: 09/264,408

[22] Filed: Mar. 3, 1999

[51] Int. Cl.[7] ..... B65D 83/00

[52] U.S. Cl. ..... 222/401; 222/402.1

[58] Field of Search ..... 222/401, 402, 222/402.1

[56] References Cited

U.S. PATENT DOCUMENTS 3,672,545 6/1972 Marand ..... 222/402

5,267,674 12/1993 Von Schuckmann ..... 222/401

*Primary Examiner*—Kevin Shaver

*Assistant Examiner*—Thach Bui

[57] ABSTRACT

A seasoning sprayer includes a container body, an inner cap, a spray member, an inner tube, an upper cap, an extensible tube, a pulling grip, a push member and a press disc. Repeatly pulling and pushing of the pulling grip can move the extensible tube in the same way in the inner tube to force and compress air flowing through air holes of the extensible tube into the inner tube and then into the container. Then the liquid seasoning stored in the container is blown by the compressed air to become fume which is then sprayed out of the head of the spray member on food by pressing the press disc.

5 Claims, 5 Drawing Sheets

SEASONING SPRAYER

BACKGROUND OF THE INVENTION

This invention relates to a seasoning sprayer, particularly to one easy to handle, and controllable in its quantity to be prayed out for use.

From olden days not recorded in history, human beings have been cooked food for eating, and seasoning is indispensable in cooking to make food palatable enough, with natural fishy or gamy flavor gotten rid of so as to be easily accepted in our mouth. And the volume of seasoning have to be adjusted to suit to personal taste, for example, in baking meat, ready-made seasoning sauces such as baking sauce, soybean sauce, vinegar, oil, etc. are commonly used and is coated on meat with brushes. But sauce on a brush is hard to control in its quantity to be coated on, resulting in unbalanced seasoning on meat. In addition, too excessive sauce may drip down from meat, wasting sauce in baking, and may be liable to stick on a hand of a person, with potential danger of scalding hands on a fire.

SUMMARY OF THE INVENTION

This invent ion has been devised to offer a seasoning sprayer especially for liquid so far rarely seen and easily handled to spray out fumed seasoning on food to be baked or roasted, and controllable in its quantity to be sprayed out.

The feature of the invention is a container with a hollow and an annular projecting wall in an inner surface and a notch in an upper end, and an inner cap resting on the annular projecting wall of the container for the head of a spray member to face so as to let liquid seasoning in the container sprayed out. Further, an inner cap rests on the annular projecting wall of the container, having an upright tubular portion with a a center hole for an extensible tube to pass through and to extend movably in the inner tube. The inner tube is positioned in the center hole of the inner cap and has air holes in its bottom for air to flow through into the container. Further, an upper cap closes on the inner tube, and the extensible tube always has its lower end in the inner tube and its upper end always protruding out of the upper end of the inner tube. When a pulling grip deposited on the container is pulled up and pushed repeatedly, it forces the extensible tube move up and down in the inner tube to force air flow through the air holes into the extensible tube and then into the inner tube and then into the container. Then the liquid seasoning in the container is blown to become fume to be sprayed out of the head of the spray member on food by pressing a press disc located on the pulling grip and a push member under the pulling grip. The press disc has an annular wall extending down for positioning a spring and an upper end of the extensible tube.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
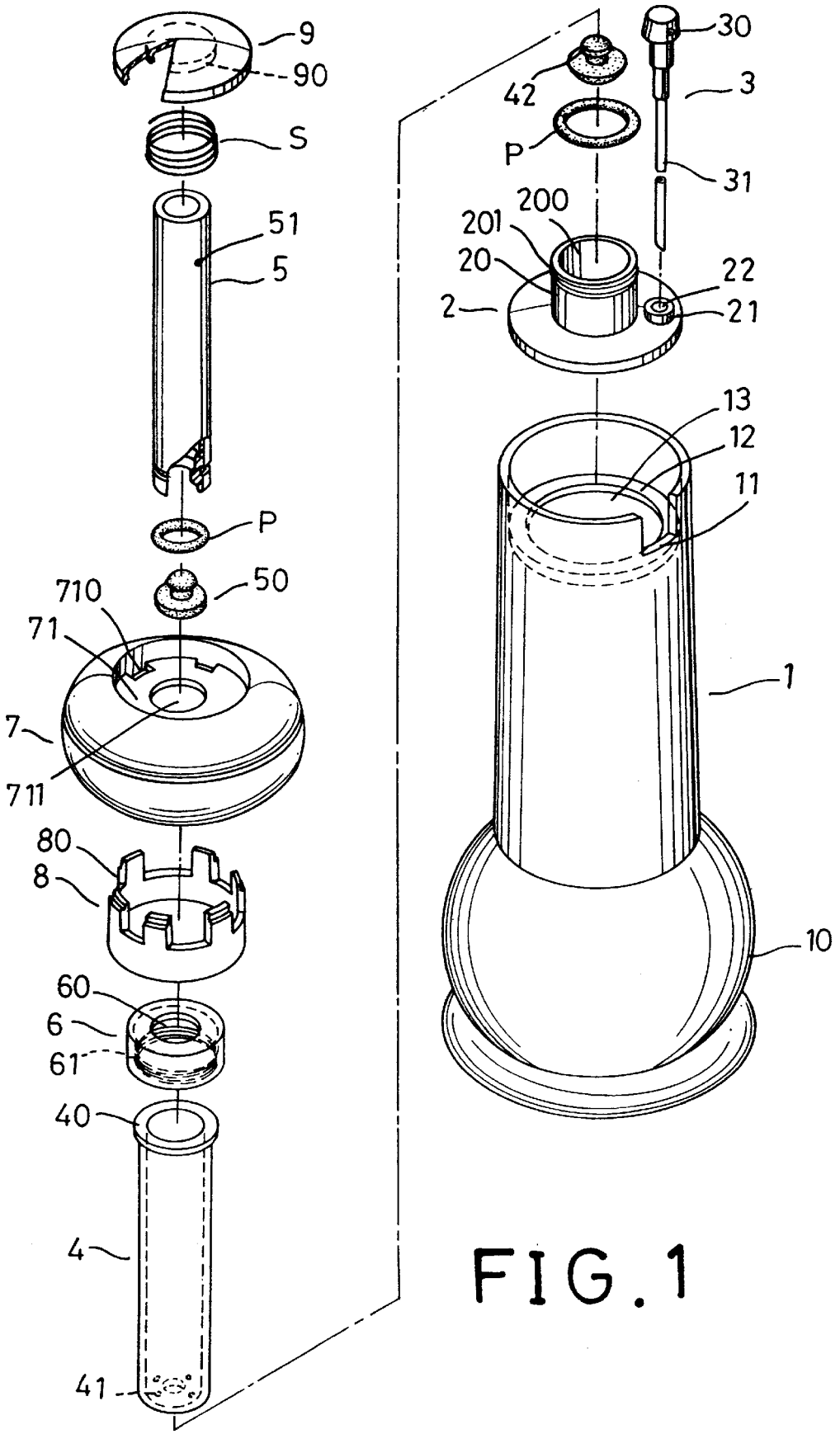
FIG. 1 is an exploded perspective view of a seasoning sprayer in the present invention.

A preferred embodiment of a seasoning sprayer in the present invention, as shown in FIG. 1, includes a container 1, an inner cap 2, a spray member 3, an inner tube 4, an extensible tube 5, an upper cap 6, a pulling grip 7, a push member 8, a press disc 9 as main components combined together.

The container 1 has a center hollow 13, a ball-shaped base 10 formed in a lower portion, an openig 11 formed in an upper circumferential wall and an annular projection edge 12 formed in an inner wall below the the opening 11.

The inner cap 2 rests on the projecting edge 12 of the container 1, having a tubular member 20 standing upright and provided with a center hole 200 and male threads 201 formed on an upper end, and a round projection 21 with a round hole 22 beside the tubular member 20.

The spray member 3 has a head 30 with a spray hole formed in an upper end and a sucking tube 31 extending down from the head 30 and through the round projection 21 of the inner cap 2. The head 30 faces the opening 11 of the container 1 to spray out seasoning fume on food, when the press disc 9 is pressed down.

The inner tube 4 has an upper flange 40 and a plurality of air holes 41 formed in its bottom, extending in the center hole 200 of the inner cap 2. The upper flange 40 rests on the upper end of the inner cap 2. Further, a stopper 42 is provided to close up the bottom and the air holes 41 of the inner tube 4.

The extensible tube 5 has a plurality of air holes 51 formed in an upper portion, extending movably in the inner tube 4 with an upper end always protruding out of the upper end of the inner tube 4. A gasket ring P engages around an outer lower surface of the extensible tube 5, and a valve 50 closes an open lower end of the extensible tube 5.

The upper cap 6 closes on the upper end of the inner tube 4, screwing threadably with the inner cap 2 having a center hole 60 communicating with the center hole 200 and female threads 61 to engage the male threads 201 of the inner cap 2.

The pulling grip 7 is located on the container 1, having a recessed surface 71 in the upper center portion, a plurality of rectangular notches 710 spaced apart on a circular edge of the recessed surface 71, and a center hole 711 for the extensible tube 5 to pass through.

The annular push member 8 is positioned under the pulling grip 7, tubular-shaped, having a plurality of rectangular projections 80 protruding upright and spaced apart to fit in the rectangular notches 710 of the pulling grip 7.

The press disc 9 is located on the pulling grip 7 and closes on the annular push member 8, having an annular wall 90 extending down and letting the upper end of the extensible tube 5 to fit around in the annular wall 90 to limit the position of the extensible tube 5. Further, a spring S is provided to fit around the annular wall 90 for moving elastically the extensible tube 5 and the push member 8.

Figure 2:
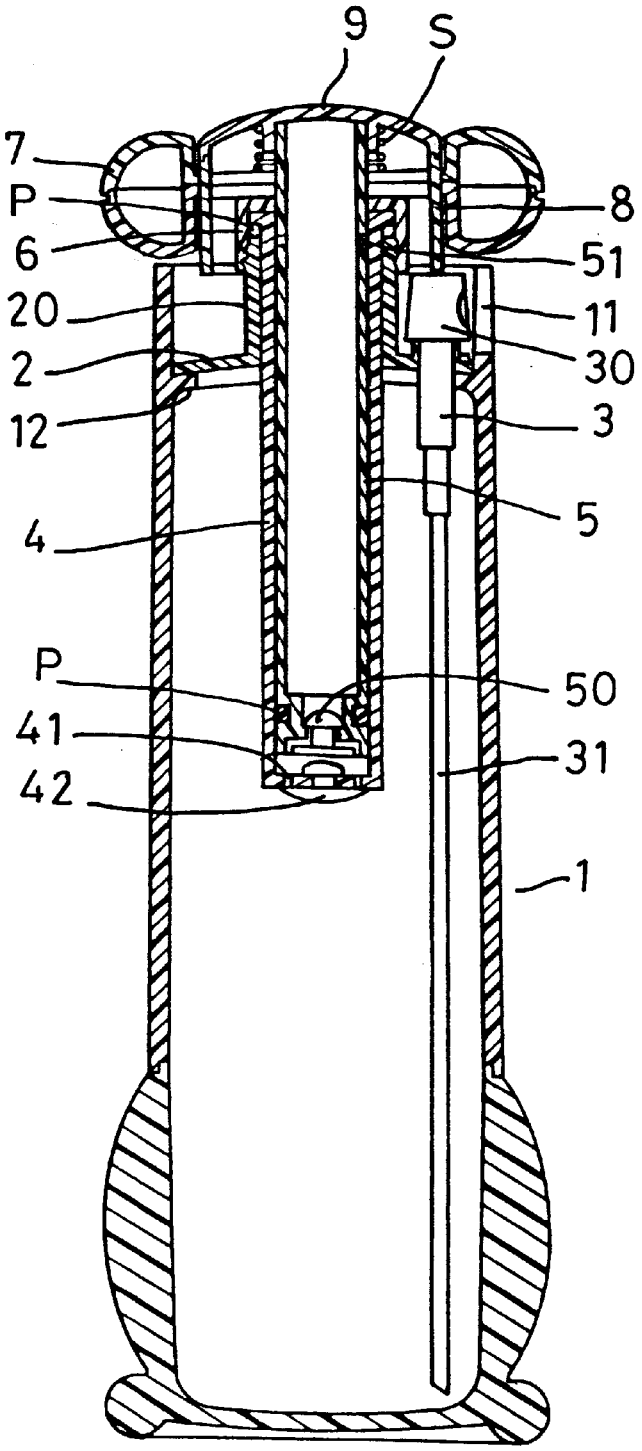
FIG. 2 is a cross-sectional view of the seasoning sprayer in the present invention.

In assembling, referring to FIGS. 1 and 2, firstly the sucking tube 31 of the spray member 3 is extended through the round hole 22 of the inner cap 2, with the head 30 positioned on the annular projection 21. Then the inner cap 2 is placed on the annular projecting edge 12 of the container 1, Next, the ring gasket P is placed tinder the flange 40 of the inner tube 4, which is then put through the center hole 200 of the inner cap 2 and into the container 1, with the flange 40 resting on the upper end of the tubular portion 20. Then the upper cap 6 is closed on the inner tube 4, with the female threads 61 engaging the male threads 201 of the tubular portion 20. After that, the extensible tube 5 is inserted through the center hole 711 of the grip 7, with its upper end positioned by fitting in the annular wall 90 of the press disc 9 with the spring S already fitted around the annular wall 90. Next, the push member 8 is combined with the pulling grip 7 by engaging the upright rectangular projections 80 with the notches 710 of the pulling grip 7. Then the press disc 9 is placed on the upright projections 80 of the push member 8 and combined tightly together (for example, with high frequency processing). Then the extensible tube 5, assembled with the components as just described, is inserted in the inner tube 4, with the bottom of the push member 8 resting on the head 30 of the spray member 3, finishing assemblage of the seasoning sprayer in the present invention.

Figure 3:
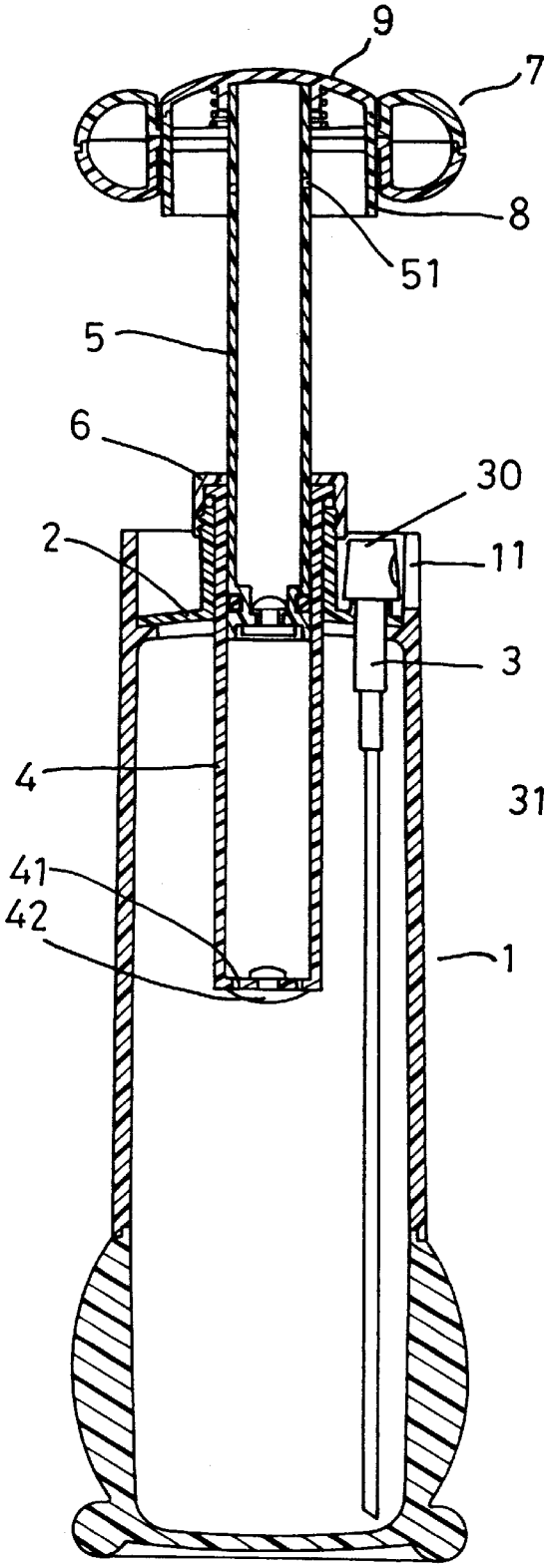
FIG. 3 is a cross-sectional view of the seasoning sprayer with a pulling grip together with an extensible tube pulled up in the present invention.
Figure 4:
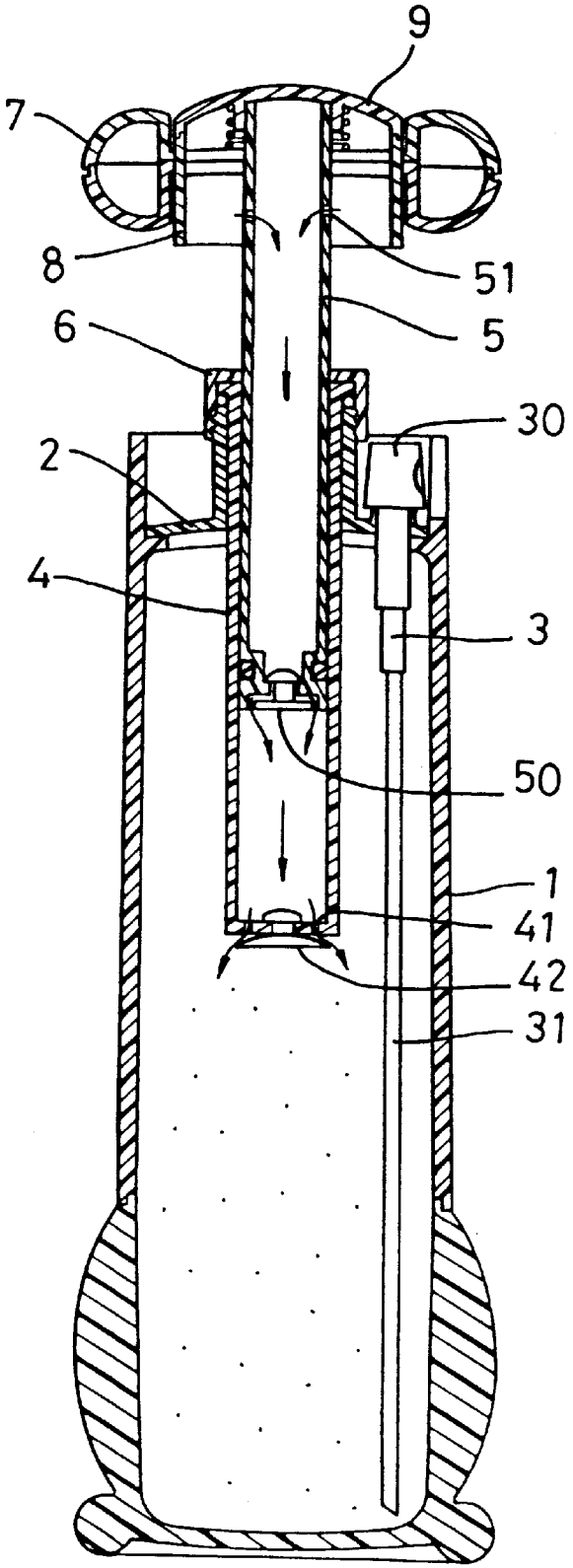
FIG. 4 is a cross-sectional view of the seasoning sprayer with the pulling grip together with the extensible tube pushed down to compress air in a container in the present invention; and, FIG. 5 is a cross-sectional view of the seasoning sprayer with seasoning stored in the container being sprayed out in the present invention.
Figure 5:
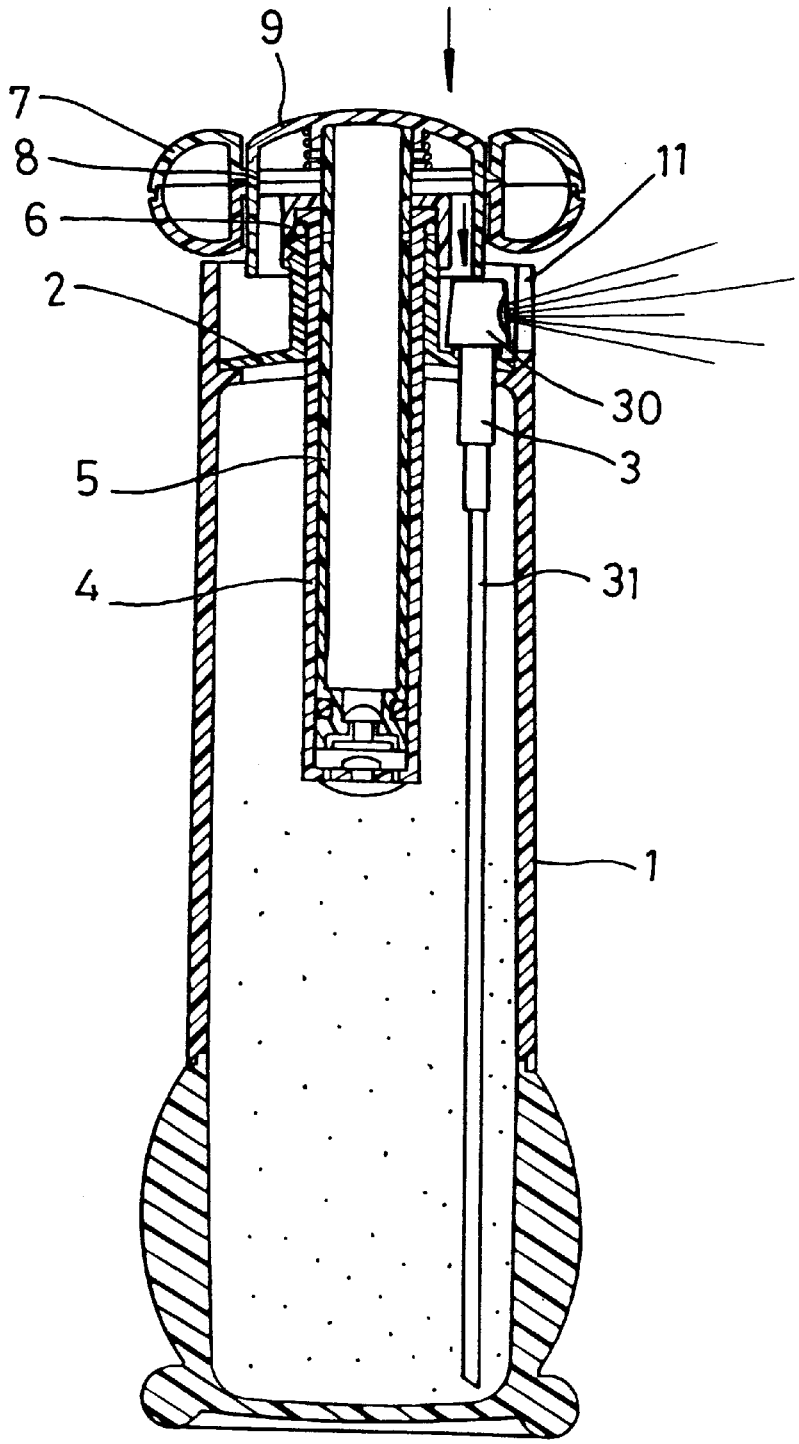

In using, referring to FIGS. 3, 4 and 5, firstly, liquid seasoning is poured and stored in the hollow of the container 1. When the seasoning is to be used, the pulling grip 7 is pulled up and pushed down repeatedly together with the extensible tube 5, as shown in FIGS. 3 and 4, letting air flow in and compressed therein to flow through the valve 50 into the inner tube 4. Then the compressed air forces the stopper 40 at the bottom of the inner tube 4 open to flow into the hollow 13 of the container 1, mixing the liquid seasoning to become seasoning fume. Then the press disc 9 is compressed to press the push member 8, which then presses the head 30 of the spray member 3 to let the seasoning fume sprayed out of the holes in the head 30 on food, as shown in FIG. 5. And a user can control quantity of the seasoning needed by handling the press disc 9.

While the preferred embodiment of the invention has been described above, it will be recognized and understood that various modifications may be made therein and the appended claims are intended to cover all such modifications which may fall within the spirit and scope of the invention.

What is claimed is:

1. A seasoning sprayer comprising:

a container having a center hollow, an annular projecting edge formed in an upper inner surface and an opening in an upper circumferential wall;

an inner cap resting on said annular projecting edge of said container, having a tubular portion standup in a center portion and provided with a center hole, and a round hole formed at one side;

a spray member inserted in said round hole of said inner cap, having a head facing said opening of said container;

an inner tube positioned in said center hole of said inner cap, having a plurality of air holes formed in its bottom;

an upper cap closing on said inner cap and said inner tube;

an extensible tube extending movably in said inner tube, having a plurality of air holes formed in an upper portion, a lower end always located in said inner tube and an upper end always protruding out of an upper end of said inner tube;

a pulling grip deposited on said container, having an upper recessed surface, a plurality of rectangular notches formed spaced apart in an outer round edge of said recessed surface, and a center hole;

a push member deposited under said pulling grip, having a tubular shape with a center hole, a plurality of projecting-up rectangular walls to fit in said notches of said pulling grip, and its bottom resting on the head of said spray member;

a press disc deposited on and tightly assembled with said push member, with a spring fitting around in inner surface to elastically move up said press disc, with the upper end of said inner tube fitting in an inner annular wall of said press disc; and, said pulling grip pulled up and pushed down repeatedly to force said extensible tube move up and down in said inner tube with air compressed and flowing through said air holes of said extensible tube into said inner tube and then into said hollow of said container to blow and mix the liquid seasoning stored therein to become seasoning fume, said press disc compressed to press said push member which pushes down said head of said spray member, said fume seasoning in said container sprayed out of said head of said spray member on food by compressing said press disc.

2. The seasoning sprayer as claimed in claim 1, wherein said tubular portion of said inner cap has male threads on an upper end, and said upper cap has female threads to engage said male threads of said inner cap and a center hole for said extensible tube to pass through.

3. The seasoning sprayer as claimed in claim 1, wherein said inner tube has a flange on an upper end to rest on an upper end of said inner cap.

4. The seasoning sprayer as claimed in claim 1, wherein a ring gasket is fitted around an lower outer surface of said extensible tube, and a valve is movably fitted in an open lower end of said extensible tube.

5. The seasoning sprayer as claimed in claim 1, wherein said press disc has an annular wall extending down for said spring and the upper end of said extensible tube to be positioned therein.

* * * * *